United States Patent [19]

Karpisek

[11] Patent Number: 4,984,333

[45] Date of Patent: Jan. 15, 1991

[54] SEPARABLE HINGE CONNECTION

[76] Inventor: Ladislav S. Karpisek, 86 Woodfield Boulevarde, Caringbah, New South Wales, 2229, Australia

[21] Appl. No.: 449,569

[22] Filed: Dec. 12, 1989

[30] Foreign Application Priority Data

Dec. 12, 1988 [AU] Australia ..... PJ1918

[51] Int. Cl.[5] ..... E05D 7/10

[52] U.S. Cl. ..... 16/266; 16/267; 16/356; 16/363; 16/377; 16/382; 16/390; 217/57

[58] Field of Search ..... 16/248, 249, 252, 265, 16/266, 267, 269, 272, 356, 363, 374, 377, 382, DIG. 40, 388, 389, 390; 49/398–400, 384; 217/46, 47, 57, 61, 65; 403/199, 253, 254, 393

[56] References Cited

U.S. PATENT DOCUMENTS

| | | | |
|---|---|---|---|
| 686,025 | 11/1901 | Canon | 16/248 |
| 718,423 | 1/1903 | Canon | 16/248 |
| 782,374 | 2/1905 | Argenbright | 16/382 |
| 1,603,741 | 10/1926 | Bridler | 16/382 |
| 1,661,419 | 3/1928 | Flagslad | 217/47 |
| 4,304,027 | 12/1981 | DiFazio | 16/249 |
| 4,357,736 | 11/1982 | Karpisek | 16/263 |

FOREIGN PATENT DOCUMENTS

| | | | |
|---|---|---|---|
| 2076463 | 12/1981 | United Kingdom | 16/266 |

*Primary Examiner*—Richard K. Seidel
*Assistant Examiner*—Edward A. Brown
*Attorney, Agent, or Firm*—Edwin D. Schindler

[57] ABSTRACT

A separable hinge connection comprising a leaf member and a pin means, the leaf member has a first hooked end which with a bridge overlying a body part of the leaf member couples the leaf member to the door and permits predetermined limited movement between the leaf member and the bridge and a second hooked end for releasable engagement with a hinge pin of the pin means, first and second stops on the pin means respectively limit rotational movement of the door and prevent vertical movement of the door for all but the final portion of the door opening movement, first and second restraining means respectively prevent and restrain the second hooked end from disengagement from the hinge pin, the second restraining means has a height above which said leaf member can be raised when the door is in said last portion of the door opening movement thereby allowing the leaf member to pass over the said second restraining means to uncouple the leaf member from the hinge pin.

5 Claims, 4 Drawing Sheets

SEPARABLE HINGE CONNECTION

This invention relates to hinge connections and in particular to hinge connections that allow a door to be demountably coupled to a support. Such hinge connections have use where the door and support are two panels of a four sided enclosure adapted for mounting upon a pallet. The panels and the pallet provide a form of container and one such container is commercially available under the name Pallecon (Trade Mark).

The hinge connection must be effective to swingably mount the door panel and allow it to be removed from the container. The hinge connections must also accommodate forces encountered by the containers when in use, such forces can cause transient or permanent distortion of the container from an upright rectangular configuration. The containers are designed to accommodate such distortions however the mounting of door panels and their removal from the fixing panels connected to the pallet can be very difficult if generous levels of movement in several directions between the hinge components is not provided.

A multi-functional hinge for the above purpose and operating conditions is disclosed in our Australian Patent 538444. The hinge of the present invention does not have all of the functions of the hinge of the said patent but provides a hinge suitable for most forms of container. The hinge of the invention is less expensive and simpler to manufacture than the hinge of the said patent and provides the levels of movement in the hinge components necessary to accommodate distortions which might occur in the containers.

Broadly the invention can be said to provide a separable hinge connection comprising a leaf member and a pin means, the leaf member has a first hooked end which with a bridge overlying a body part of the leaf member couples the leaf member to the door and permits predetermined limited movement between the leaf member and the bridge and a second hooked end for releasable engagement with a hinge pin of the pin means, a lug on the second hooked end of the leaf member and a co-operating first stop on the pin means to limit the maximum arc of door opening movement, a second stop on the pin means overlying the upper edge of the second hooked end of the leaf member except for the last portion of the maximum door opening movement when said second hooked end passes beyond the second stop means, first and second means to respectively prevent and restrain removal of the second hooked member from the hinge pin in first and second directions respectively, said second means having a height above which said leaf member can be raised when the door is in said last portion of the door opening movement thereby allowing the leaf member to pass over the said second means in said second direction to uncouple the leaf member from the hinge pin.

Figure 1:
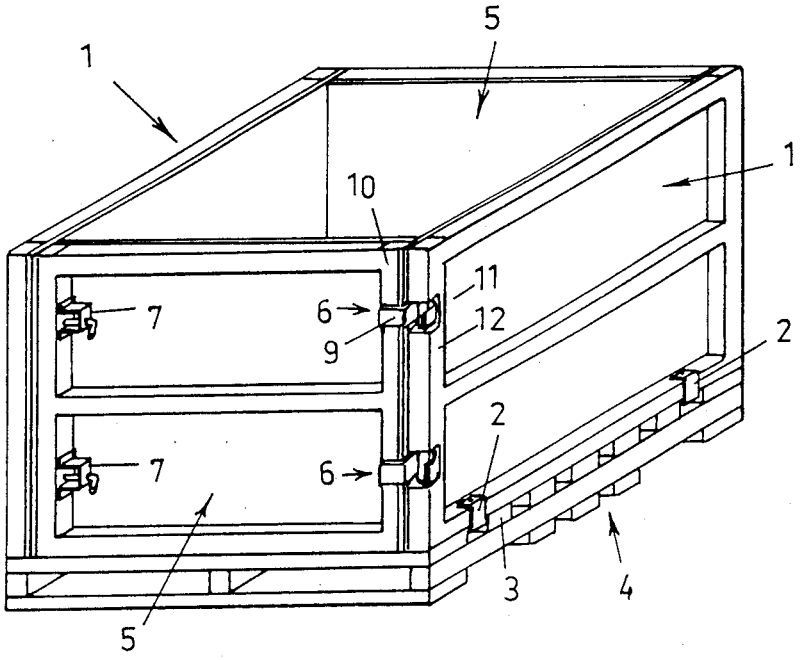
Figure 2:
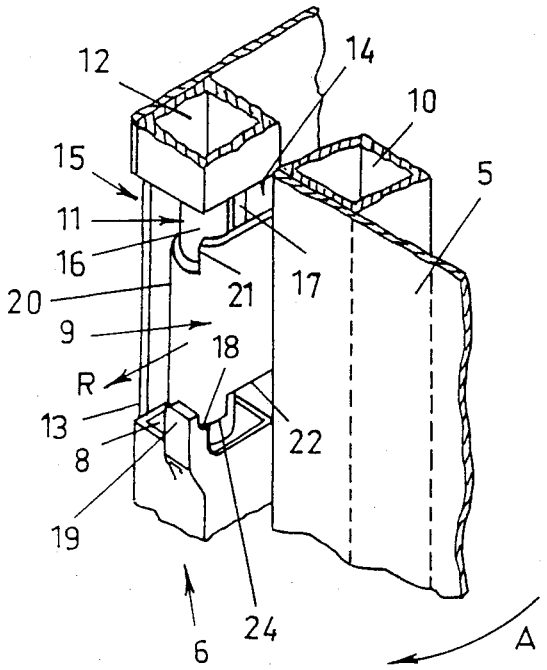
Figure 6:
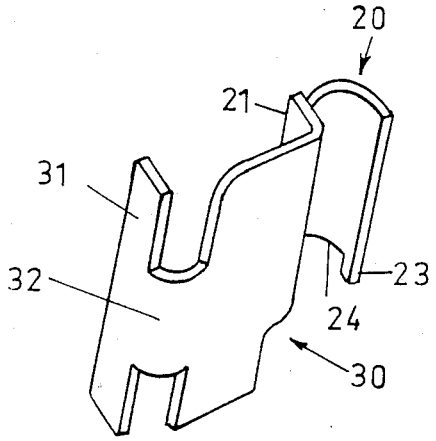
Figure 3:
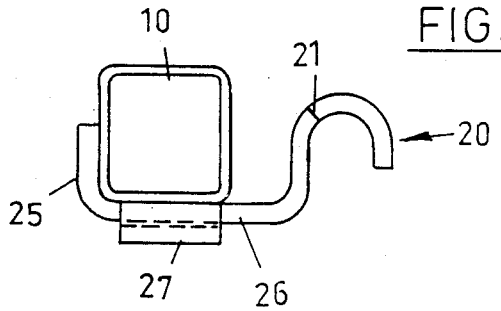
Figure 4:
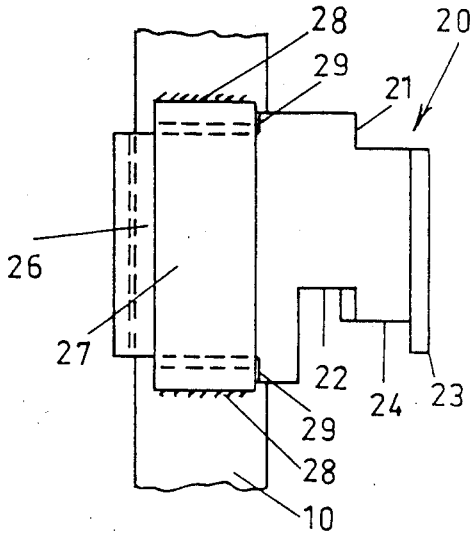
Figure 5:
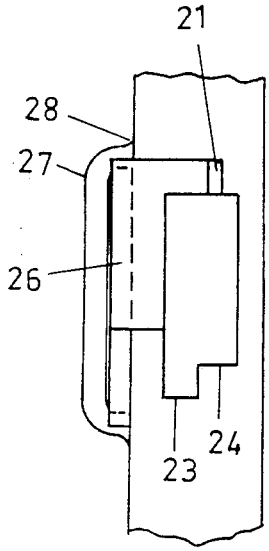
Figure 7:
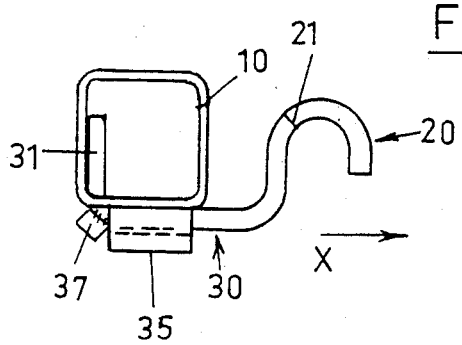
Figure 8:
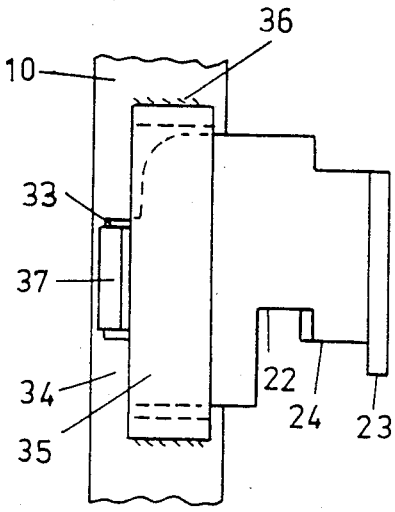
Figure 9:
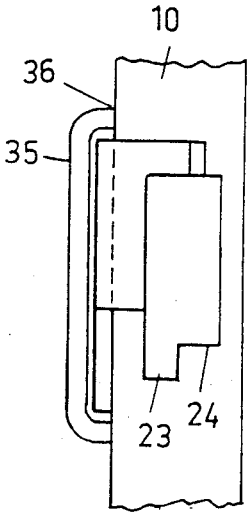

Two presently preferred forms of the invention will now be described with reference to the drawings in which :

FIG. 1 is a perspective view of a collapsible container for which the hinge connection of the present invention is applicable and for which the hinge connection has been primarily designed, FIG. 2 is a perspective view of a hinge connection according to the invention, FIG. 3 is a plan view of components for a first embodiment of the hinge connection of the invention, FIG. 4 is a side view of the components of FIG. 3, FIG. 5 is a front view of the component of FIG. 3, FIG. 6 is a perspective view of a component for a second embodiment of the invention, FIG. 7 is a plan view of components for the second embodiment of the hinge connection of the invention, FIG. 8 is a side view of the components of FIG. 7, and FIG. 9 is a front view of the components of FIG. 7.

Referring to the drawings, FIG. 1 illustrates a typical Pallecon container wherein two fixing pannels 1 are fixed by cleats 2 in known manner to the battens 3 of a pallet 4. Door panels 5 are coupled by hinges 6 to the panels 1 and securing device such as bolts 7 secure the door panels to the fixing panels and maintain the integrity of the enclosure comprised of two fixing panels and two door panels.

The hinges 6 allow the door panels to be rotated through an arc relative to the fixing panels and the form of the hinges is such that the door panels can be uncoupled from the fixing panels.

A typical hinge construction as disclosed in the perspective view FIG. 2 in which the hinge components are arranged ready for disconnection of the door panel from a fixing panel. The hinge comprises a leaf 9 fixed in a required manner to the post 10 of a door panel 5 and the leaf is engaged with a hinge pin assembly 11 mounted in an opening in a fixing panel post 12.

With respect to the hinge pin assembly the post 12 is of square tube and is cut away on two sides to leave a side portion 13 and a back portion 14 in place. Mounted in the tube 12 at the top and bottom of the opening 15, provided by the removal of the tube sides, upper and lower hinge pin supports 8 are provided to anchor the ends of the hinge pin 16. At the upper end of the opening 15 and adjacent the hinge pin 16 there is a first stop member 17 and diametrically opposite the stop 17 and at the bottom of the opening 15 there is a restrainer and stop member comprised of a land 18 and an upstanding removal restraining lug 19.

The leaf part of the hinge comprises a body with a first hooked end, to be described, and a second hooked end of the form shown in the Australian patent 538444 which is removably engageable with the hinge pin 16. The second hooked end is in the form of a curl or U configuration as indicated 20 in order to closely embrace the pin 16. On the upper edge there is a shoulder 21 which is intended to engage against the stop 17 to limit the closing movement of the door panel. The shoulder 21 is prefered but not essential.

In the lower edge of the portion 20 there is a notch 22 and a lug 23 on the lower edge extends downwardly from the edge at the free end of the portion 20. There is a land portion 24 of the bottom edge of the portion 20 between the notch 22 and the lug 23.

From the FIG. 2 condition two sequences can be followed. In a first sequence the door panel can be closed. In the closing operation arrow A, the lug 23 which now abuts the stop 18, out of sight in FIG. 2, moves away from the stop 18 and the land 24 rides over the top surface of the stop 18 with the bottom edge of the lug 23 riding on the lower pin support 8. As rotation continues the top edge of the portion 20 passes under the stop 17 preventing the leaf and the door panel attached to it from being raised. As the rotation continues the lug 19 will pass through the notch 22 and rotation continues until the door is closed or the shoulder 21, if provided, engages the first stop member 17.

In the other sequence the door panel can be removed. In the FIG. 2 condition when the lug 23 engages the stop 18 the free end of the curled portion 20 will be free of the stop 17 allowing the leaf and the door attached to it to be raised. The width of the leaf relative to the height of the opening 15 is such that the leaf can be raised sufficiently to pass over the top of the lug 19 in the direction of the arrow R.

The first hooked end of the hinge leaf can have one of two forms as illustrated in FIGS. 3 to 5 and FIGS. 6 to 9. The embodiment of FIGS. 3 to 5 is preferred and the attachment of the leaf to the post 10 is by means of a hooked end leg 25 which engages against the outer face of the post 10 and provides the strength needed to resist the loads applied to the hinges by the outward pressure of goods loaded into the container. The leaf body 26, which is in the form of a strap with a width dimension considerably greater than its thickness dimension, lies below a bridge 27 fixed at 28 to the post 10. There is both width and thickness clearance between the leaf body 26 and the opening below the bridge 27. There are shoulders 29 on the leaf body 26 and the shoulders 29 are spaced from the inner face of the leg 25 sufficiently to provide a predetermined limited movement potential between the leaf member and the post 10.

The arrangement provides for the sometimes rough and careless handling that containers can encounter. As will be understood working conditions such as standing on irregular surfaces or mishandling can cause transient or permanent distortion of the containers from the designed shape and configuration. In order to accommodate such distortions and still allow the door panels to open and be removed there needs to be a limited amount of freedom in the hinge connections. The present invention provides such freedom in a simple and effective manner.

The embodiment of FIGS. 6 to 9 is for circumstances where the leg 25 of the above arrangement is not acceptable on the outer face of the post 10. This embodiment utilizes a leaf member as illustrated in FIG. 6 where the leaf body 30 has the hooked attachment end in the form of a T with the crossbar 31 of the T housed within the tubular post 10 and the body 32 of the T passing with clearance through an aperture 33 in the face 34 of the post 10.

Again there is a bridge 35 which overlies the body of the leaf and is fixed at 36 to the post 10. Both forward and rearward movement of the leaf body will be limited by the sides of the aperture 33 and accordingly there is no need for the shoulders 29 of the FIG. 4 embodiment. To provide the required strength in the direction of the arrow X as will be applied by the load within a container, a lug 37 is fixed to the body of the leaf so as to bear against the bridge 35. Again the arrangement provides the required degree of limited movement between the leaf and the post 10 thereby to accommodate any distortion which the container may encounter in service.

I claim:

1. A separable hinge connection comprising a leaf member and pin means, the leaf member having a first hooked end and a second hooked end, a bridge overlying with clearance a body part of the leaf member intermediate the ends of the leaf member, the first hooked end and the bridge permanently coupling the leaf member to a door having the leaf body part being disposed between the bridge and the door for permitting limited free movement to a pre-determined extent of the leaf member in all directions relative to the door, the second hooked end being for releasable engagement with a hinge pin of the pin means, a lug on the second hooked end of the leaf member and a cooperating first stop on the pin means limiting the maximum arc of door opening movement, a second stop on the pin means overlying an upper edge of the second hooked end of the leaf member except for a last portion of the maximum door opening movement when said second hooked end passes beyond the second stop means, first means and second means, respectively, for preventing and restraining removal of the second hooked end from the hinge pin in a first direction and a second direction, respectively, said second means having a height above which said leaf member is raisable in the first direction when the door is in said last portion of the door opening movement thereby allowing the leaf member to pass over said second means in said direction to uncouple the leaf member from the hinge pin.

2. A separable hinge connection between a door and a door support wherein the hinge connection comprises a leaf member of strap form with a width dimension substantially greater than its thickness dimension mounted on an edge of the door and pin means mounted on or forming part of the door support, said leaf member comprising a body part between a hooked first end in the form of a leg which lies substantially at right angles to a plane of the leaf body and is in engagement with the door and a hooked second end in the form of a curl spaced from an inner face of the door to partially embrace the pin means for allowing the hooked second end to engage with and disengage from the pin means, a bridge fixed to and spaced from an edge of a post and overlying the body part of the leaf member which lies between the bridge and the post, clearance between the bridge and the post and between the bridge and the leaf member body part being sufficient for allowing limited free movement to a predetermined extent of the body part of the leaf member both longitudinally and laterally relative to the post, a stop lug on said hooked second end of the leaf member adjacent a free end thereof, said pin means including a hinge pin, first restraining means spaced radically from the hinge pin for preventing otherwise unrestrained radical disengagement of said hooked second end from the hinge pin in a first direction during an arc of door movement, upper stop means overlying an upper edge of said hooked second end of the leaf member during all but a final portion of the arc of door opening movement, lower stop means being engageable by said stop lug for limiting the extent of the door opening movement, second restraining means being spaced radially from said hinge pin with said hooked second end being disposed between said second restraining means and said hinge pin, at least when said upper edge of said hooked second end is not positioned below the upper stop means, thereby preventing otherwise unrestrained radial disengagement of said hooked second end from the hinge pin in a second direction, the length of the hinge pin and the height of the second restraining means being sufficient so that the door is able to be raised sufficiently to position the lower edge of said hooked second end above the second restraining means thereby permitting disengaging movement of the door in said second direction.

3. The separable hinge connection as claimed in claim 2, wherein said hooked first end of the leaf member is positioned adjacent an outer face of the door and leaf member body includes shoulder means positioned adjacent said bridge with the leaf member having a predetermined degree of movement in a direction at right angles to a plane in which said door lies wherein the movement is limited by the engagement of the shoulder means with the bridge and the hooked first end of the leaf member with the outer face of the post.

4. The separable hinge connection as claimed in claim 2, wherein the door member includes a hollow post to which the leaf member is connected, said hooked first end of the leaf member being of a T-shape comprising a cross-bar and a body, the cross-bar of the "T" is housed with the door post and the body of the "T" extends through a slot in the door post with clearance around said "T" body, said leaf member having a pre-determined degree of movement in a direction at right angles to a plane in which said door lies with said movement limited by the width of the slot of the door post.

5. The separable hinge connection as claimed in claim 4, further comprising a reinforcement abutment member on the body of the leaf positioned adjacent the bridge member and remote from said inner face of the door.

* * * * *